US006081931A

United States Patent [19]

Burns et al.

[11] Patent Number: 6,081,931

[45] **Date of Patent: *Jul. 4, 2000**

[54] PROTECTIVE HELMET SUSPENSION SYSTEM

[75] Inventors: James A. Burns, Lake Elmo; Brett R. Johnson, St. Paul; Kevin C. Johnson, Minneapolis, all of Minn.

[73] Assignee: 3M Innovative Properties Company, St. Paul, Minn.

[ * ] Notice: This patent issued on a continued prosecution application filed under 37 CFR 1.53(d), and is subject to the twenty year patent term provisions of 35 U.S.C. 154(a)(2).

[21] Appl. No.: 09/041,057

[22] Filed: Mar. 10, 1998

[51] Int. Cl.[7] ..... A42B 3/00

[52] U.S. Cl. ..... 2/411; 2/416

[58] Field of Search ..... 2/410, 411, 416, 2/418, 420, 5

[56] References Cited

U.S. PATENT DOCUMENTS

| | | | |
|---|---|---|---|
| 2,585,937 | 2/1952 | Johnson et al. | 2/416 |
| 3,192,536 | 7/1965 | Benner | 2/416 |
| 3,383,705 | 5/1968 | Raschke | 2/416 |
| 3,555,560 | 1/1971 | Raschke | 2/418 |
| 3,633,214 | 1/1972 | Newcomb | 2/418 |
| 4,040,123 | 8/1977 | Williams | 2/10 |
| 4,055,860 | 11/1977 | King | 2/416 |
| 4,286,339 | 9/1981 | Coombs | 2/414 |
| 4,527,290 | 7/1985 | Zahn | 2/416 |
| 4,942,628 | 7/1990 | Freund | 2/416 |
| 5,054,479 | 10/1991 | Yelland et al. | 128/201 |
| 5,113,534 | 5/1992 | Lane et al. | 2/416 |
| 5,150,479 | 9/1992 | Oleson | 2/414 |
| 5,319,808 | 6/1994 | Bishop et al. | 2/416 |
| 5,619,754 | 4/1997 | Thurwanger et al. | 2/418 |

FOREIGN PATENT DOCUMENTS

| | | | |
|---|---|---|---|
| 227849 | 4/1960 | Australia | 2/416 |
| 87 14 490 | 9/1988 | Germany . | |

*Primary Examiner*—Michael A. Neas

[57] ABSTRACT

A suspension system for a helmet comprising a crown support assembly having a center portion and a plurality of strap portions extending radially from the center portion. The suspension system further comprises a headband and a plurality of connectors, wherein at least one of the plurality of connectors comprises an anchor portion for attaching the suspension system to a helmet, a first support member extending from the anchor portion and attached to one of the plurality of strap portions, a second support member spaced from the first support member, extending from the anchor portion, and attached to the headband, and a spacing member extending from one of the first and second support members toward the other of the first and second support members. The connector may be a single piece, and may be a molded piece. The connector may also comprise at least one more spacing member extending from one of the first and second support members toward the other of the first and second support members.

16 Claims, 3 Drawing Sheets

PROTECTIVE HELMET SUSPENSION SYSTEM

TECHNICAL FIELD

The present invention relates to protective helmets and more particularly to a suspension system that supports the helmet on a wearer's head.

BACKGROUND OF THE INVENTION

Protective helmets are commonly worn by people such as firefighters, construction workers, and athletes to shield their heads from flying or falling objects. The helmet usually includes a rigid protective shell of impact resistant material. For some applications, the helmets may also include visors or face shields to protect the eyes or the entire face of the wearer, and may further include a respirator to protect the wearer's respiratory system.

Various government agencies and industry organizations define certain requirements and standards for protective gear, including helmets and respirators. In the United States, for example, the National Institute of Occupational Safety and Health (NIOSH) certifies certain safety equipment for the workplace and the American National Standards Institute (ANSI) recommends voluntary consensus industry standards. Other agencies and organizations around the world also establish safety standards for helmets and respirators. For protective helmets, some of these standards relate to impact energy attenuation, penetration resistance, force transmission, stiffness, flammability, and head coverage.

To meet these safety requirements and standards, protective helmets usually comprise a rigid outer shell of metal or plastic and a suspension system inside the shell. The suspension system serves many purposes, including providing a proper fit of the helmet to the wearer's head, holding the inner part of the helmet away from the wearer's head, distributing the weight of the helmet over a larger area of the wearer's head, and attenuating the force transferred to the wearer's head upon impact of an object with the outer helmet shell. Suspension systems often comprise a headband attached to a crown support assembly which includes criss-crossing crown straps and a crown pad. In some applications, however, additional protection may be desired. In these situations, a foam liner may be provided between the inner shelf and suspension of the helmet to provide additional impact protection.

The manner of attaching suspension systems to a helmet typically depend on whether or not the helmet has a liner. In many cases, a suspension system in a helmet having a liner incorporates the liner itself into the suspension attachment system. These suspension systems will not typically fit properly into a helmet that does not have a liner. For example, U.S. Pat. No. 5,150,479 (Oleson) describes a helmet having a foam liner and a suspension system, where the suspension system has a plurality of straps attached to anchors which rest in a channel in an outer surface portion of the foam liner. Thus, the manner of attaching the suspension system to this helmet relies specifically on the presence of a liner in the helmet.

Similarly, the manner of attaching a suspension system in a helmet without a liner will not typically provide the necessary space to accommodate the insertion of a liner. To use these systems designed for linerless helmets in a helmet having a liner, a portion of the liner may need to be cut away to allow the suspension to be inserted into the helmet. The removal of liner material may cause an undesirable reduction in the impact resistance of the helmet. To maintain a sufficient amount of liner material in the helmet, helmets having a liner therefore typically require a different suspension system design than that used in helmets without a liner.

SUMMARY OF THE INVENTION

The present invention provides a suspension system that may be interchangeable between helmets having liners and helmets without liners. The suspension system is provided with connectors for attaching the suspension system to helmets and for properly positioning the suspension system and helmet on a wearer's head.

In one aspect of this invention, a suspension system for a helmet is provided, wherein the suspension system comprises a crown support assembly having a center portion and a plurality of strap portions extending radially from the center portion. The suspension system further comprises a headband and a plurality of connectors, wherein at least one of the plurality of connectors comprises an anchor portion for attaching the suspension system to a helmet, a first support member extending from the anchor portion and attached to one of the plurality of strap portions, a second support member spaced from the first support member, extending from the anchor portion, and attached to the headband, and a spacing member extending from one of the first and second support members toward the other of the first and second support members. The present invention also includes within its scope that the connector may be a single piece, and may be a molded piece. It is also within the scope of the present invention that the connector may comprise at least one more spacing member extending from one of the first and second support members toward the other of the first and second support members.

In another aspect of the present invention, a protective headgear system is provided, wherein the headgear system comprises a helmet having an inner surface and an outer surface opposite the inner surface, and a suspension system removably attached to the helmet. The suspension system comprises a crown support assembly which includes a center portion an a plurality of strap portions extending radially from the center portion, a headband, and a plurality of connectors. In this embodiment, at least one of the plurality of connectors comprises an anchor portion for removably attaching the suspension system to the helmet, a first support member extending from the anchor portion and attached to one of the plurality of strap portions, a second support member spaced from the first support member, extending from the anchor portion, and attached to the headband, and a spacing member extending from one of the first and second support members toward the other of the first and second support members. In this aspect of the invention, the headgear system may also include a liner adjacent to the inner surface of the helmet, wherein the liner has a thickness, and the first support member of the connector may be spaced from the second support member of the connector by a distance that is at least as large as the thickness of the liner.

BRIEF DESCRIPTION OF THE DRAWINGS

The present invention will be further explained with reference to the appended Figures, wherein like structure is referred to by like numerals throughout the several views, and wherein.

DETAILED DESCRIPTION OF THE PREFERRED EMBODIMENTS

Figure 1:
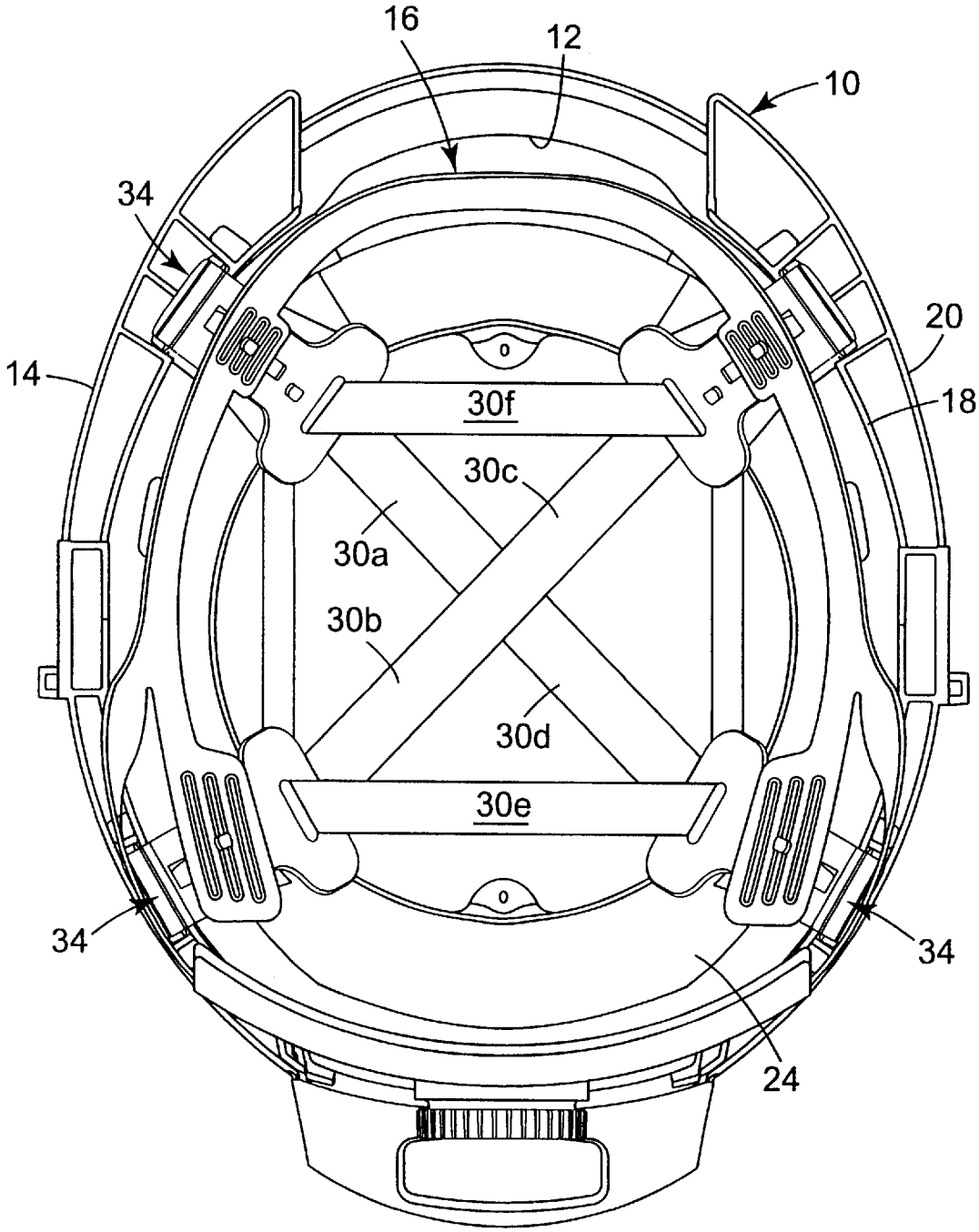
FIG. 1 is a bottom view of a helmet having a suspension system according to the present invention.
Figure 2:
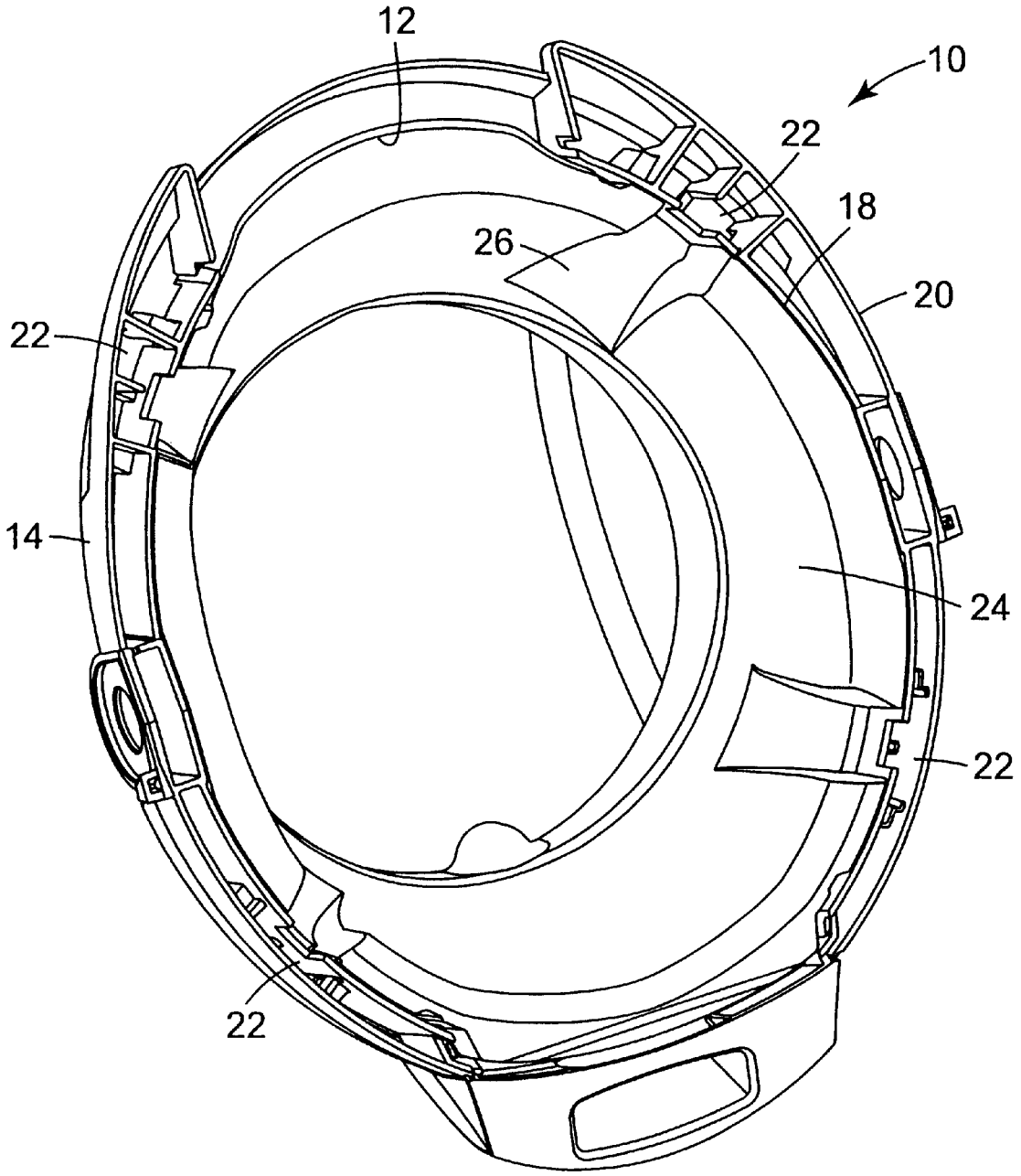
FIG. 2 is a bottom perspective view of the helmet without a suspension system.

Referring now to the Figures, wherein the components are labeled with like numerals throughout the several Figures, and initially to FIG. 1, one preferred embodiment of a helmet 10 is illustrated, which basic components include an inner shell 12, a rigid outer shell 14 spaced from inner shell 12, and a helmet suspension assembly 16. When assembled, the outer shell 14 is superposed over the inner shell 12 so that a base edge 18 of inner shell 12 is spaced from a base edge 20 of outer shell 14. FIG. 2 shows the helmet of FIG. 1 with suspension assembly 16 removed therefrom, and better shows multiple slots 22 that are provided between the base edges 18, 20 for engagement with the suspension assembly 16, as described below.

Helmet 10 is optionally provided with a liner 24 adjacent to the inner shell 12. The liner 24 is preferably designed so that an outer surface of the liner closely corresponds to the interior surface of the inner helmet shell 12 to provide a tight fit between liner 24 and inner shell 12. The liner 24 may be removably attached to the inner shell 12 by any suitable manner, or may be simply held in place by a frictional fit between shell 12 and liner 24. The liner 24 may be constructed of any material that provides the necessary amount of protection, such as materials that are generally compressible and non-resilient, including foam materials such as polyurethane, expanded styrene, and the like. In accordance with the present invention, the liner 24 preferably has several notches 26 around its periphery, where these notches 26 generally correspond to the position of the mounting slots 22 when liner 24 is positioned within the helmet 10.

Figure 3:
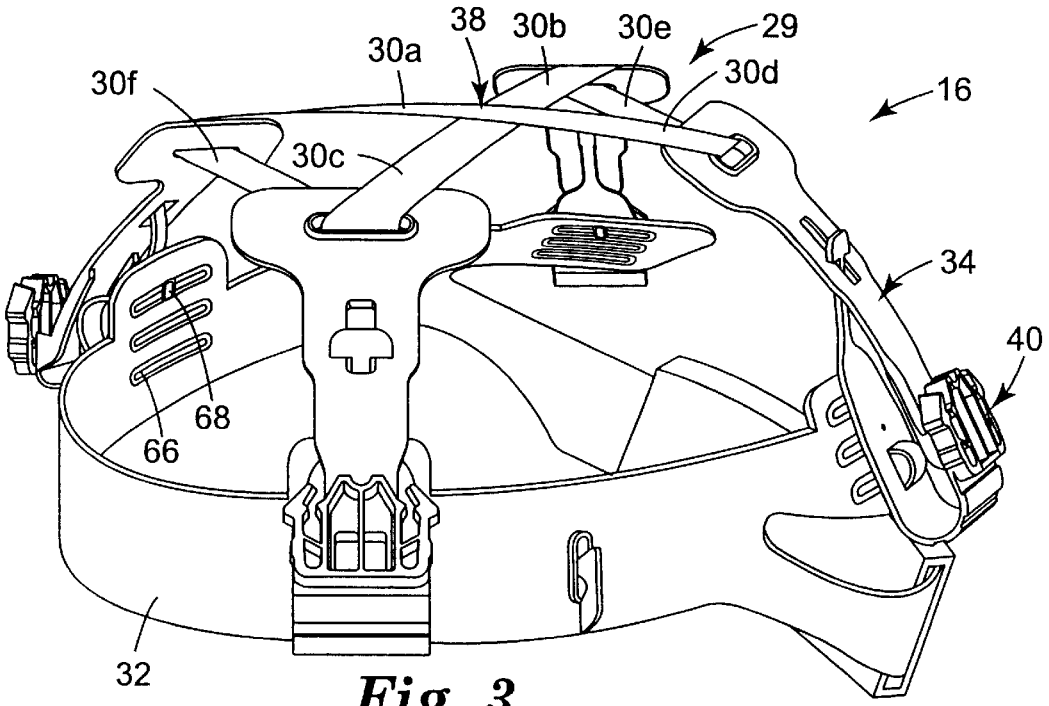
FIG. 3 is a perspective view of the suspension system according to the present invention.

With additional reference now to FIG. 3, the helmet suspension assembly 16 generally comprises a crown support assembly or cap 29, an adjustable headband 32, and a plurality of connectors 34 for releasably attaching the suspension assembly 16 to helmet 10. Cap 29 preferably comprises four flexible strap portions, designated as 30*a* through 30*d*, however, any suitable number of straps that can properly support the helmet on the wearer's head may be used. Straps 30*a* through 30*d* are preferably constructed of a strong web material, such as nylon, and are arranged for resting comfortably on a wearer's head. As illustrated, the four strap portions 30*a* through 30*d* preferably extend radially from a center area 38 of the cap 29. The ends of the strap portions 30*a* through 30*d* that are furthest from the center area 38 may also be connected to each other by additional strap portions, such as those designated as 30*e* and 30*f*. In the embodiment shown, a single piece of strap material is sewn and arranged in one possible configuration of the cap 29. However, the cap 29 may instead comprise multiple pieces of material attached to each other, such as by sewing. Other configurations of straps or strap portions arranged into a cap or crown support are also considered to be within the scope of the present invention. A crown pad (not shown) may also be provided in the center area of the cap, and may be connected thereto, to provide additional comfort and cushioning between the straps 30*a* through 30*d* and the wearer's head.

In order to properly position the helmet 10 on the wearer's head, it is preferable that headband 32 is adjustable in circumference to accommodate various head sizes and shapes. Although the headband adjustment in FIGS. 1 and 3 is shown as a ratchet mechanism including a ratchet adjustment knob, it is known that the headband 32 may be adjustable by various means, all of which are considered to be within the scope of the invention. In addition, it is preferable that the headband 32 be made of a flexible material, such as polyethylene, polypropylene, polyester, polyvinyl, and the like, that can easily conform to the size and shape of the wearer's head. The headband 32 may also include a sweat band or covering (not shown) to increase the comfort of the wearer.

The headband 32 is attached to the cap 29 by the connectors 34 that may also be used to attach the suspension assembly 16 to helmet 10. More specifically, connectors 34 are used both to attach the straps 30*a* through 30*d* to the headband 32, and to removably attach the entire suspension assembly 16 to the helmet 10. Thus, there should be one connector 34 corresponding to each strap in order to connect the cap 29 to the headband 32. In the illustrated embodiment, there are four connectors 34 to correspond to the four strap portions 30*a* through 30*d*.

FIG. 3 shows an enlarged view of connector 34 according to the present invention. Specifically, one preferred embodiment of connector 34 comprises an anchor tab 40 for attaching the suspension assembly 16 to the helmet, a first or strap connection member 42 that extends generally from the anchor tab 40 for connection to a strap, a second or headband connection member 44 that is spaced from the first connection member 42 and extends generally from the anchor tab 40 for connection to the headband 32, and a spacing member 46 provided between members 42 and 44. Each of these components of connector 34 is discussed in more detail below.

Figure 4:
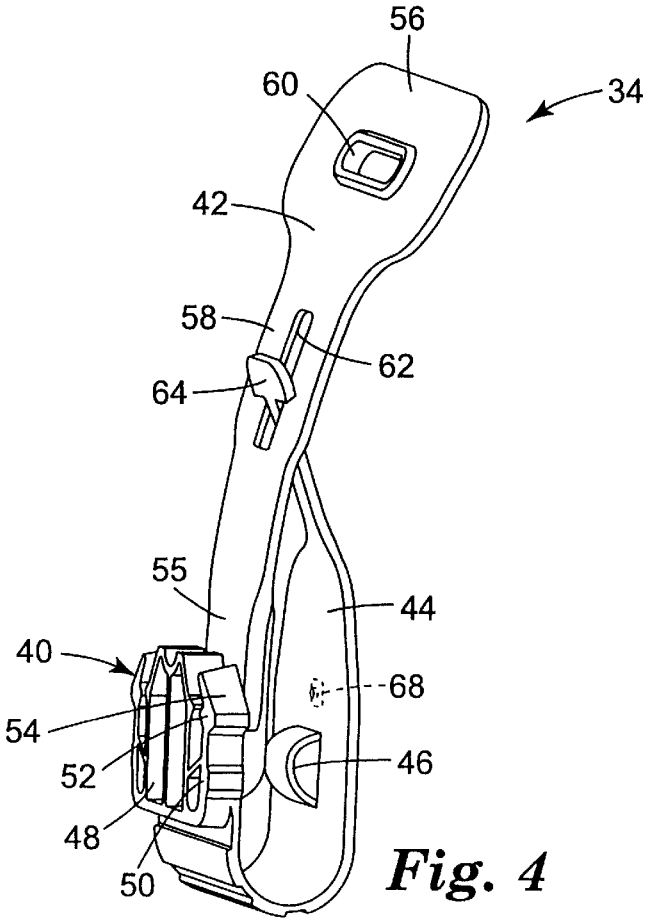
FIG. 4 is a perspective view of a suspension system connector according to the present invention.

Anchor tab 40 is used to attach the suspension assembly 16 to the helmet, where the tab design illustrated in FIG. 4 is one preferred design. In this embodiment, tab 40 has a body portion 48 and two compression portions 50, each having a flange 52 extending therefrom. The body portion 48 is generally rigid and may have support ribs molded therein for strength. The compression portions 50 are relatively rigid, but are compressible relative to the body portion 48 so that they can move toward and away from the body portion 48 to decrease and increase the width of the tab 40, respectively, when inserting or removing the tab from slot 22 of helmet 10. In order to better hold the anchor tab 40 within the slot 22, the slot 22 may further be provided with a notch or groove (not shown) for engagement with the flanges 52 of the anchor tab. The flanges 52 are further provided with an angled edge 54 for easier insertion into the slot 22. To engage the anchor tab 40 with the slot 22, the compression portions 50 are positioned so that the angled edge 54 of each flange 52 is in contact with an opposite side of the slot 22. As the anchor tab 40 is pressed into the slot 22, the extending flanges 52 push the compression portions 50 toward the body portion 48. When the anchor tab 40 is further inserted into the slot 22, the flange 52 engages with the notch or groove in the slot 22 (when provided), which allows the compression portions 50 to move or "spring" away from the body portion 48, thereby securing the anchor tab 40 within the slot 22. It is understood, however, that the anchor tab 40 may be designed to attach to the helmet in various different ways, all of which are considered to be within the scope of this invention.

First or strap connection member 42 extends from the anchor tab 40 for connection to a strap that is part of a crown support assembly or cap. With continued reference to FIG. 4, member 42 preferably includes a first end portion 55 generally adjacent to the anchor tab 40, a second end portion 56 opposite the end portion 55, and an intermediate portion 58 between the first and second end portions 55, 56. As shown, the second end portion 56 is provided with a slot or hole 60 for receiving a strap. To attach a strap to the member 42, a strap may be threaded through the slot 60 and attached either to itself, such as by sewing, may be attached to the member 42 with an adhesive, or may be connected to the member 42 by some other manner of attachment. Alternatively, the member 42 may not have a hole provided therein, and some other known manner of attaching the strap to the member 42 could instead be used. In the preferred embodiment, a single piece of web material is threaded through the slot 60 of each of the four strap connection members 42 and arranged so that the strap portions 30*a* through 30*d* can move relative to each other to vary the distribution of the weight of the helmet on the wearer's head. Alternatively, the strap portions may be permanently attached to each other or another device near the center area 38 of cap 29, or may be arranged in some other configuration.

Second or headband connection member 44 extends generally from the anchor tab 40 for connection to the headband 32. More specifically, a tab 68 (shown in FIG. 3) preferably projects from the outer surface of member 44, and headband 32 includes at least one channel 66 in which the tab 68 can engage. Headband 32 is preferably provided with multiple channels 66 to allow the wearer to choose the channel that provides the best fit of the suspension system on his or her head. However, other known manners of providing adjustability are also within the scope of the invention. Alternatively, no adjustability of the connector 34 relative to the headband 32 may be provided.

Members 42 and 44 are spaced from each other along at least a part of their lengths, but are attached to each other at some point along their lengths. In the preferred embodiment, member 44 preferably connects to the member 42 by providing the member 42 with a slot 62 in the intermediate portion 58 and providing the member 44 with an end portion 64 that is generally T-shaped and corresponds to the slot 62. To connect the members, the end portion 64 is partially rotated to line up with the slot 62 so that the end portion 64 may be inserted therein. After inserting the end portion 64 into the slot 62, the end portion 64 may be released so that it rotates back to its original position, thereby locking the end portion 64 in the slot 62.

In the preferred embodiment, the connector 34 is a single molded piece of flexible material, where the first and second connection members 42, 44 can be fastened to each other in a variety of known ways. However, it is understood that the connector 34 may instead comprise multiple pieces that are welded or otherwise attached to each other. It is further contemplated that the connection members 42, 44 not have a detachable connection, such as that described above, and that the members 42, 44 instead be permanently molded or otherwise attached to each other.

Spacing member 46 preferably projects from the headband connection member 44 and extends toward member 42. The spacing member 46 is designed so that if member 42 is pushed toward member 44, such as when an object strikes the outer surface of the helmet and pushes the helmet toward the wearer's head, the spacing member 46 can partially compress, thereby absorbing some of the impact transmitted through a helmet. Thus, the spacing member 46 acts like a spring which compresses or flattens to absorb a portion of the impact energy and protect the wearer's head. Additionally, when suspension assembly 16 is mounted in a helmet without a liner, spacing member 46 helps keep the member 42 and 44 spaced from each other, preferably by a distance that minimizes movement of the suspension 16 within the helmet. In one preferred embodiment, member 46 prevents members 42, 44 from being spaced closer to each other than the thickness of a liner that would be inserted into a particular helmet. Although spacing member 46 is shown in FIG. 4 as projecting from the headband connection member 44, it is understood that the spacing member 46 may instead project from the strap connection member 42, or may comprise spacing members on both members 42, 44.

In one preferred embodiment that provides a cost-effective manufacture of the connector 34, the spacing member 46 is a molded loop of the same material of which the remainder of the connector 34 is made. It is understood, however, that the spacing member 46 may be made of a different material than the connector 34, and that the spacing member 46 may be attached to the connector 34 by any of various known appropriate attachment means, such as adhesive bonding, welding, and the like. Further, the spacing member 46 may comprise a different configuration, such as a leaf spring, for one example. For another example, the spacing member 46 may be a piece of material, such as foam or another partially compressible material, attached to at least one of the members 42, 44.

As described above, the suspension system of the present invention does not rely on the presence or absence of a liner in a helmet for proper attachment thereof. The suspension system does not need any adjustments to accommodate the removal or addition of a liner. In operation, the suspension system is mounted in a helmet that may or may not have a liner by simply sliding the anchor portion 40 of each of the connectors 34 into a corresponding slot in the periphery of the helmet so that the connector locks in place. The suspension system is then secured to the helmet. The suspension system may be removed from the helmet by pulling the connectors from their corresponding slots. The suspension system may then be reinstalled in another or the same helmet, with or without a liner, by repeating the above process.

The helmet 10 described above is typically worn by a person to shield his or her head from falling or flying objects. However, the helmet may also be provided with additional features for different environments and applications. For one example (not shown), the helmet may be used in a respirator assembly which includes a face shield, a welding shield, or the like for protecting the eyes and respiratory system of the wearer. In this example, the helmet of the respirator typically has a generally dome-shaped passageway or chamber between the inner and outer shells of the helmet, a rear opening or receptacle designed to accept an air supply hose, and a front opening designed to allow the supplied air to escape into the face area and breathing zone of the wearer. Thus, it will be appreciated by those skilled in the art that the suspension system of the present invention may be used in many different applications where a person's head needs protection.

The present invention has now been described with reference to several embodiments thereof. The foregoing detailed description has been given for clarity of understanding only. No unnecessary limitations are to be understood therefrom. It will be apparent to those skilled in the art that many changes can be made in the embodiments described without departing from the scope of the invention. Thus, the scope of the present invention should not be limited to the structures described herein, but only by the structures described by the language of the claims and the equivalents of those structures.

What is claimed is:

1. A suspension system for a helmet, the suspension system comprising:

a crown support assembly comprising a center portion and a plurality of strap portions extending radially from the center portion, a headband; and a plurality of connectors, wherein at least one of the plurality of connectors comprises:

an anchor portion for attaching the suspension system to a helmet;

a first support member extending from the anchor portion and attached to one of the plurality of strap portions;

a second support member spaced from the first support member, extending from the anchor portion, and attached to the headband, the second support member having a distal end attachable to the connector; and a spacing member extending from one of the first and second support members toward the other of the first and second support members.

2. The suspension system of claim 1, wherein the first support member has a first end, a second end spaced from the first end, and an intermediate portion between the first and second ends, and wherein the second support member is attached to the intermediate portion of the first support member.

3. The suspension system of claim 2, wherein the intermediate portion of the first support member comprises a slot and wherein the second support member has an end engageable with the slot of the first support member.

4. The suspension system of claim 1, wherein the connector is a single piece.

5. The suspension system of claim 4, wherein the connector is a molded piece.

6. The suspension system of claim 1, wherein the headband comprises at least one channel and wherein the second support member comprises a tab portion engageable with the at least one channel.

7. The suspension system of claim 1, wherein the spacing member comprises a generally semicircular loop portion.

8. The suspension system of claim 1, wherein the spacing member comprises a leaf spring.

9. The suspension member of claim 1, wherein the spacing member comprises a resilient material piece.

10. A connector for attaching a suspension system to protective headgear, wherein the suspension system comprises a plurality of strap portions and a headband, and wherein the connector comprises:

an anchor portion;

a first support member extending from the anchor portion for attaching to one of the plurality of strap portions;

a second support member spaced from the first support member and extending from the anchor portion and adapted to attach to the headband, the second support member having a distal end attachable to the connector; and a spacing member extending from one of the first and second support members toward the other of the first and second support members.

11. The connector of claim 10, wherein the connector comprises a single piece.

12. The connector of claim 10, wherein the second support member comprises a tab portion for engaging with the headband.

13. A protective headgear system comprising:

a helmet having an inner surface and an outer surface opposite the inner surface; and a suspension system removably attached to the helmet, wherein the suspension system comprises:

a crown support assembly comprising a center portion and a plurality of strap portions extending radially from the center portion;

a headband; and a plurality of connectors, wherein at least one of the connectors comprises:

an anchor portion for removably attaching the suspension system to the helmet;

a first support member extending from the anchor portion and attached to one of the plurality of strap portions;

a second support member spaced from the first support member, extending from the anchor portion, and attached to the headband, the second support member having a distal end attachable to the connector; and a spacing member extending from one of the first and second support members toward the other of the first and second support members.

14. The protective headgear assembly of claim 13, further comprising a liner adjacent to the inner surface of the helmet.

15. The protective headgear system of claim 14, wherein the liner has a thickness and wherein the first support member is spaced from the second support member by a distance that is at least as large as the thickness of the liner.

16. The protective headgear system of claim 13, wherein the helmet further comprises at least one slot engageable with the anchor portion of the at least one connector.

* * * * *

UNITED STATES PATENT AND TRADEMARK OFFICE

CERTIFICATE OF CORRECTION

PATENT NO. : 6,081,931
DATED : July 4, 2000
INVENTOR(S) : James A. Burns, Brett R. Johnson and Kevin C. Johnson It is certified that error appears in the above-identified patent and that said Letters Patent is hereby corrected as shown below:

Title page,
Item [56], FOREIGN PATENT DOCUMENTS SECTION, "87 14 490" should read -- 87 140490.5 --.

Column 1,
Line 44, "shelf" should read -- shell --.

Signed and Sealed this

Thirteenth Day of November, 2001

*Attest:*

Nicholas P. Godici

*Attesting Officer*

NICHOLAS P. GODICI
*Acting Director of the United States Patent and Trademark Office*